US008062435B2

(12) United States Patent
Cuyler et al.

(10) Patent No.: US 8,062,435 B2
(45) Date of Patent: Nov. 22, 2011

(54) PHOSPHATING OPERATION

(75) Inventors: Brian B. Cuyler, Oxford, MI (US); Kevin K. Meagher, Northville, MI (US); Timm L. Kelly, Birmingham, MI (US)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 10/311,440

(22) PCT Filed: Jun. 18, 2001

(86) PCT No.: PCT/US01/19499

§ 371 (c)(1),
(2), (4) Date: Jun. 24, 2003

(87) PCT Pub. No.: WO01/96627

PCT Pub. Date: Dec. 20, 2001

(65) Prior Publication Data

US 2004/0011430 A1 Jan. 22, 2004

Related U.S. Application Data

(60) Provisional application No. 60/212,205, filed on Jun. 16, 2000.

(51) Int. Cl.
*C23C 22/07* (2006.01)

(52) U.S. Cl. ..... 148/253; 148/262

(58) Field of Classification Search ..... 148/253–255, 148/260–263, 523; 106/14.12, 14.44
See application file for complete search history.

(56) References Cited

U.S. PATENT DOCUMENTS

| | | | | | |
|---|---|---|---|---|---|
| 2,316,810 | A | | 4/1943 | Romig | |
| 3,240,633 | A | | 3/1966 | Gowman et al. | |
| 3,338,755 | A | * | 8/1967 | Jenkins et al. | 148/262 |
| 3,523,043 | A | | 8/1970 | Newell et al. | |
| 3,870,573 | A | | 3/1975 | Smith | |
| 4,486,241 | A | | 12/1984 | Donofrio | |
| 4,670,066 | A | | 6/1987 | Schapira et al. | |
| 4,681,641 | A | | 7/1987 | Zurilla et al. | |
| 4,865,653 | A | * | 9/1989 | Kramer | 205/111 |
| 5,203,930 | A | | 4/1993 | Bluemlhuber et al. | |
| 5,236,565 | A | * | 8/1993 | Muller et al. | 204/486 |
| 5,261,973 | A | * | 11/1993 | Sienkowski et al. | 148/262 |
| 5,482,746 | A | * | 1/1996 | Liberti et al. | 427/379 |
| 5,868,874 | A | | 2/1999 | Rossio | |
| 6,068,709 | A | * | 5/2000 | Schapira et al. | 148/253 |
| 6,461,450 | B1 | * | 10/2002 | Riesop et al. | 148/262 |

FOREIGN PATENT DOCUMENTS

| | | | |
|---|---|---|---|
| GB | 996418 | * | 6/1965 |
| JP | 61-79782 A | | 4/1986 |
| JP | 08-134661 | * | 5/1996 |

* cited by examiner

*Primary Examiner* — Roy King
*Assistant Examiner* — Christopher Kessler
(74) *Attorney, Agent, or Firm* — Mark K Cameron

(57) ABSTRACT

Operational problems such as scale and sludge formation which are encountered in phosphating processes using compositions containing zinc and at least one of Ni, Co, or Zn may be alleviated by maintaining an effective level of dissolved iron cations in such compositions.

26 Claims, No Drawings

PHOSPHATING OPERATION

This application is the US National Phase application of and claims priority from International Application Number PCT/US01/19499, filed Jun. 18, 2001, which was published under PCT Article 21(2) in English on Dec. 20, 2001, as WO 01/96627 A1. This application also claims priority from US provisional application Ser. No. 60/212,205, filed Jun. 16, 2000, which priority was also claimed in said International Application.

BACKGROUND OF THE INVENTION

This invention relates to the well known general field of phosphate conversion coating of metals and more particularly to phosphate coatings formed from a liquid phosphating composition that contains both zinc and at least one of nickel, cobalt, and manganese as layer forming cations. The coatings formed from such a phosphating composition normally contain both zinc and at least the one(s) of nickel, cobalt, and zinc also present in the phosphating compositions. These coatings may also contain iron, particularly if a ferriferous substrate such as ordinary (non-stainless) steel is being phosphated.

Almost all phosphating compositions and processes are subject to the formation of "sludge", a solid phase that separates spontaneously from the liquid phosphating composition as the latter is used. The major components of sludge are water-insoluble phosphates, usually of more or less the same type(s) that constitute the desired conversion coating. Although some attempts have been made to re-use sludge, in most commercial operations it still represents an economically significant cost of phosphating, because the anions and cations incorporated into the sludge generally must be replenished along with the ions from the phosphating composition that actually form the desired phosphate conversion coating. Sludge generally either sinks to the bottom of any container in which it forms or floats on the liquid phosphating composition from which it forms and therefore can be easily removed from the liquid phosphating composition by filtering or skimming if desired or needed. Sludge also is usually only weakly adherent to metal surfaces, and if it does accumulate on them can be readily removed by brushing, water flush, or the like.

A phenomenon less common than sludging that is sometimes observed in commercial phosphating is the formation of an adherent scale on process equipment, such as squeegee rolls, immersion heaters and heat exchangers, that must be kept in contact with the phosphating compositions during their use in order to maintain optimum conditions for phosphating. No phosphate conversion coating of these items of process equipment is desired, and the objects are generally made of non-metals such as rubber for squeegee rolls or of metals such as stainless steel on which normal phosphate conversion coatings do not spontaneously form. Nevertheless, when these objects, especially if their surfaces are hot, are maintained in contact with liquid phosphating compositions for extended periods of time, a relatively hard, adherent, and difficult to remove scale develops over the part of the surface in contact with the phosphating composition. Such scale is usually a heat insulator, so that even a relatively thin coating of the scale substantially impedes the heat transfer, between the metal and the phosphating compositions, that is a major reason for maintaining many of the metal surfaces in contact with the phosphating composition in the first place. On some other surfaces, such as squeegee rolls, the scale can interfere with the intended operation of the process equipment in other ways. The scale must therefore be periodically removed, often as much as every few hours of operation, and scale must usually be removed primarily by hand labor. Its removal therefore is often very costly.

In many commercial phosphating operations, particularly continuous operations such as those usually used to phosphate large metal coils, there is a large fixed capital cost of the equipment used for the phosphating, so that it is economically important to obtain the phosphate coatings rapidly, thereby diminishing the fixed cost per item of production by distributing this cost over more items. In most instances, phosphating reactions proceed more rapidly at higher rather than lower temperatures. A high phosphating temperature is therefore desirable to minimize fixed costs per production item, but if the high temperature causes more rapid scaling as it usually does when the phosphating composition used has a tendency to form scale, the cost of scale removal may destroy the economic benefit of faster phosphating.

Phosphating compositions with a high total concentration of cations of divalent nickel, divalent cobalt, and/or divalent manganese (these three types of cations being hereinafter usually jointly referred to as "NCM") along with zinc, as taught in U.S. Pat. No. 4,681,641 of Jul. 21, 1987 to Zurilla et al., often provide better corrosion resistance to the metal substrates covered with them than do almost any other kind of commonly used phosphating. However, they are also more prone to sludging and, when the total NCM content is very high, are much more prone to scaling than almost any other type of commonly used phosphating process.

Accordingly, a major object of this invention is to provide high NCM phosphating compositions and/or processes that produce less sludge and/or scaling than previously used high NCM phosphating, particularly when the processes are operated at high temperatures.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); the term "paint" and all of its grammatical variations are intended to include any similar more specialized terms, such as "lacquer", "varnish", "electrophoretic paint", "top coat", "color coat", "radiation curable coating", or the like and their grammatical variations; and the term "mole" and its grammatical variations may be applied to elemental, ionic, and any other chemical species defined by number and type of atoms present, as well as to compounds with well defined molecules.

BRIEF SUMMARY OF THE INVENTION

It has surprisingly been found that the presence of iron cations (particularly ferric cations) in an otherwise conventional high NCM zinc phosphating composition reduces the formation of scale and/or sludge, even when the phosphating composition is maintained at a high temperature.

Embodiments of the invention include working aqueous liquid compositions suitable for contacting directly with metal surfaces to provide conversion coatings thereon; liquid or solid concentrates that will form such working aqueous liquid compositions upon dilution with water, optionally with addition of other ingredients; processes of using working aqueous liquid compositions according to the invention as defined above to form protective coatings on metal surfaces and, optionally, to further process the metal objects with surfaces so protected; protective solid coatings on metal surfaces formed in such a process, and metal articles bearing such a protective coating.

DETAILED DESCRIPTION OF THE INVENTION AND PREFERRED EMBODIMENTS

A working composition according to the invention preferably comprises water and the following components:

(A) dissolved phosphate anions;
(B) dissolved NCM cations;
(C) dissolved zinc cations; and
(D) dissolved iron cations.

One or more of undissolved iron cations and the following components may also be present in the working composition:

(E) a phosphating accelerator that is not part of any of components (A) through (D) as recited immediately above;
(F) dissolved fluoride ions that are not part of any of components (A) through (E) as recited immediately above;
(G) an acidity adjustment agent that is not part of any of components (A) through (F) as recited immediately above; and
(H) sludge conditioner that is not part of any of components (A) through (G) as recited immediately above.

In a composition according to the invention, component (A) preferably, at least for economy, is sourced to a composition according to the invention by at least one of orthophosphoric acid and its salts of any degree of neutralization. Component (A) can also be sourced to a composition according to the invention by pyrophosphate and other more highly condensed phosphates, including metaphosphates, which tend at the preferred concentrations for at least working compositions according to the invention to hydrolyze to orthophosphates. However, inasmuch as the condensed phosphates are usually at least as expensive as orthophosphates, there is little practical incentive to use condensed phosphates, except possibly to prepare extremely highly concentrated liquid compositions according to the invention, in which condensed phosphates may be more soluble.

Whatever its source, the concentration of component (A) in a working composition according to the invention, measured as its stoichiometric equivalent as $PO_4^{-3}$ anions with the stoichiometry based on equal numbers of phosphorus atoms, preferably is at least, with increasing preference in the order given, 0.2, 0.4, 0.6, 0.70, 0.75, 0.80, 0.84, 0.86, 0.88, 0.90, or 0.92% and independently preferably is not more than, with increasing preference in the order given, 20, 10, 6.5, 5.0, 4.0, 3.5, 3.0, 2.0, 1.8, 1.6, or 1.4%.

Component (B) of dissolved NCM cations is preferably sourced to the composition as at least one nitrate or phosphate salt (which may of course be prepared by dissolving the elemental metal and/or an oxide or carbonate thereof in acid), although any other sufficiently soluble salt of the NCM cations may be used. The entire NCM cations content of any water-soluble NCM salt dissolved in a composition according to the invention is presumed to be NCM cations in solution, irrespective of any coordinate complex formation or other physical or chemical bonding of the NCM cations with other constituents of the composition according to the invention. Independently of their source, the concentration of NCM cations in a working composition according to the invention preferably is at least, with increasing preference in the order given, 0.4, 0.6, 0.8, 0.10, 0.12, 0.14, 0.16, 0.18, or 0.20% and independently preferably is not more than, with increasing preference in the order given, 1.5, 1.0, 0.8, 0.70, 0.60, 0.55, 0.50, or 0.47%. If the concentration of NCM is too low, the improved corrosion resistance associated with a "high NCM" phosphating composition will not usually be achieved, while if this concentration is too high, the cost of the composition will increase inordinately without any corresponding increase in performance. Among the NCM cations, nickel is most preferred because it is at least slightly more effective in imparting high alkaline corrosion resistance than cobalt or manganese.

Zinc cations for component (C) are preferably sourced to a composition according to the invention from at least one zinc phosphate salt, at least one zinc nitrate salt, and/or by dissolving at least one of metallic zinc, zinc oxide, and zinc carbonate in a precursor composition that contains at least enough phosphoric and/or nitric acid to convert the zinc content of the oxide to a dissolved zinc salt. However, these preferences are primarily for economy and availability of commercial materials free from amounts of impurities that adversely affect phosphating reactions, so that any other suitable source of dissolved zinc cations could also be used. As for NCM, the entire zinc content of any salt or other compound dissolved or reacted with acid in a composition according to the invention is to be presumed to be present as cations when determining whether the concentration of zinc cations satisfies a concentration preference as noted below.

In any working composition according to the invention, the concentration of zinc cations preferably is at least, with increasing preference in the order given, 0.010, 0.020, 0.030, 0.040, 0.045, or 0.049% and independently preferably is not more than, with increasing preference in the order given, 2.0, 1.5, 1.2, 1.0, 0.80, 0.70, 0.60, 0.55, 0.50, 0.45, 0.40, 0.36, or 0.33%. In the first of two alternative especially preferred embodiments of the invention, one in which the NCM cations concentration is higher than the zinc cations concentration: the concentration of zinc cations additionally preferably is not greater than, with increasing preference in the order given, 0.20, 0.15, 0.10, 0.08, or 0.06%; and, independently, the ratio of zinc cations to NCM cations preferably is at least, with increasing preference in the order given, 0.03:1.00, 0.05:1.00, 0.07:1.00, 0.09:1.00, or 0.11:1.00 and independently preferably is not more than, with increasing preference in the order given, 0.9:1.00, 0.7:1.00, 0.5:1.00, 0.40:1.00, 0.35:1.00, 0.30:1.00, 0.25:1.00, 0.20:1.00, or 0.15:1.00. In the second of these two alternative especially preferred embodiments of the invention, one in which the concentration of zinc ions is greater than the concentration of NCM ions: the concentration of zinc cations additionally preferably is at least, with increasing preference in the order given, 0.075, 0.10, 0.15, 0.20, 0.23, 0.25, 0.27, 0.29, or 0.31 percent; and, independently, the ratio of zinc cations to NCM cations preferably is at least, with increasing preference in the order given, 1.10:1.00, 1.20:1.00, 1.30:1.00, 1.35:1.00, 1.40:1.00, 1.45:1.00, 1.50:1.00, 1.55:1.00, or 1.58:1.00 and independently preferably is not more than, with increasing preference in the order given, 7:1.00, 5:1.00, 3.0:1.00, 2.7:1.00, 2.5:1.00, 2.3:1.00, 2.1:1.00, 1.9:1.00, or 1.7:1.00.

Component (D) of iron cations is preferably sourced to a phosphating composition according to the invention by a source of iron(III) ions, most preferably ferric nitrate although other water-soluble sources of ferric ions may be used. The solubilities of ferric phosphate and of ferric hydroxide are rather low in the presence of preferred amounts of other constituents of a preferred phosphating composition according to this invention, and it is in certain embodiments of the invention preferred to maintain the dissolved iron(III) cations at their saturation value by supplying an excess of ferric salt, most of which remains undissolved unless and until some of the dissolved ferric ions are removed from the composition by drag-out, precipitation as sludge, or the like. It should be noted that the solubilities of ferric salts are affected by pH. At relatively low pH levels (high acidity) such as are typically present in the concentrate compositions of the present invention (replenisher or make-up), the ferric salt will generally be more soluble than at higher pH levels. Precipitation of a portion of the ferric salt dissolved in a replenisher or make-up concentrate will thus commonly be observed when the concentrate is diluted in the working phosphating composition.

The concentration of dissolved iron cations in a working phosphating composition according to the invention preferably is at least, with increasing preference in the order given, 40, 60, 80, or 100% of its saturation level, which is believed to correspond to about 10 parts of dissolved iron per million parts by weight of total phosphating composition (this unit of concentration being freely used hereinafter for any constituent of a phosphating composition and being hereinafter usually abbreviated as "ppm"). In order to assure maintenance of the most preferred fully saturated concentration of dissolved iron cations, it is preferred to provide to a phosphating composition according to the invention an amount of total ferric salt that contains at least, with increasing preference in the order given, 20, 30, 40, 50, or 60 ppm of iron cations.

In at least certain embodiments of the invention, however, it may be desirable to limit the amount of total ferric salt provided to the phosphating composition. At very high levels of total ferric salt, excessive sludging and/or scaling may take place. For this reason, it may be advantageous to provide to the phosphating composition an amount of total ferric salt that contains not more than, with increasing preference in the order given, 700, 600, 500, 400, 200 or 100 ppm of iron cations.

Optional component (E) of conversion coating accelerator preferably is present in a composition according to the invention, because without this component the coating formation rate usually is slower than is desired. The accelerator when present in a working composition according to the invention preferably is selected from the group consisting of: 0.3 to 4 parts of chlorate ions per thousand parts of total phosphating composition, this unit of concentration being freely used hereinafter for any constituent of the composition and being hereinafter usually abbreviated as "ppt"; 0.01 to 0.2 ppt of nitrite ions; 0.05 to 2 ppt of m-nitrobenzene sulfonate ions; 0.05 to 2 ppt of m-nitrobenzoate ions; 0.05 to 2 ppt of p-nitrophenol; 0.005 to 0.15 ppt of hydrogen peroxide in free or bound form; 0.1 to 10 ppt of hydroxylamine in free or bound form; 0.1 to 10 ppt of a reducing sugar; and 1 to 30 ppt of nitrate ions. Nitrate ions are preferred within this group and are most preferably used without any of the other accelerators in this group. Nitrate ions are preferably sourced to the composition by at least one of nitric acid and its salts. When nitrate ions are present in a working composition according to the invention, their concentration more preferably is at least, with increasing preference in the order given, 1.5, 2.0, 2.5, 3.0, 3.3, 3.6, 3.9, 4.1, or 4.3 ppt and independently preferably is not more than, with increasing preference in the order given, 25, 20, 17, 15, 13, 11, or 9.0 ppt. (If the concentration of nitrate is too high, the danger of emissions of noxious oxides of nitrogen from the phosphating composition is increased.)

The presence of optional component (F) of dissolved fluoride in a composition according to the invention is also preferred, because without it the danger of forming the small surface blemishes known in art as "white specking", "seediness", or the like is increased when phosphating zinciferous surfaces, and there is also less likelihood of obtaining the most desired crystal morphology. More preferably, this fluoride is sourced to the composition in two differing forms: "uncomplexed fluoride" supplied by hydrofluoric acid and/or one of its salts (which may be partially or totally neutralized); and "complexed fluoride" supplied to the composition by at least one of the acids $HBF_4$, $H_2SiF_6$, $H_2TiF_6$, $H_2ZrF_6$, and $H_2HfF_6$, and their salts (which also may be partially or totally neutralized). Among this group, $H_2SiF_6$ and its salts are most preferred, the acid itself being usually preferred for economy and ready commercial availability.

When both uncomplexed and complexed fluorides are present in a working phosphating composition according to the invention and the concentration of NCM in the phosphating composition is greater than the concentration of zinc measured in the same mass-based units: the concentration of uncomplexed fluoride in the phosphating composition preferably is at least, with increasing preference in the order given, 0.02, 0.04, 0.06, 0.08, 0.10, 0.12, 0.14, or 0.16 ppt and independently preferably is not more than, with increasing preference in the order given, 2.0, 1.5, 1.0, 0.8, 0.6, 0.40, 0.35, 0.30, 0.25, 0.23, 0.21, 0.19, or 0.17 ppt; independently, the concentration of complexed fluoride in the phosphating composition preferably is at least, with increasing preference in the order given, 0.04, 0.08, 0.12, 0.16, 0.20, 0.24, 0.28, 0.31, 0.33, 0.35, or 0.37 ppt and independently preferably is not more than, with increasing preference in the order given, 4.5, 3.5, 2.5, 2.0, 1.5, 1.0, 0.90, 0.80, 0.70, 0.60, 0.50, 0.45, or 0.40 ppt; and, independently, the ratio of uncomplexed fluoride to complexed fluoride preferably is at least, with increasing preference in the order given, 0.05:1.00, 0.10:1.00, 0.15:1.00, 0.20:1.00, 0.25:1.00, 0.30:1.00, 0.35:1.00, 0.39:1.00, 0.41:1.00, or 0.43:1.00 and independently preferably is not more than, with increasing preference in the order given, 4:1.00, 2.0:1.00, 1.5:1.00, 1.00:1.00, 0.80:1.00, 0.70:1.00, 0.65:1.00, 0.60:1.00, 0.55:1.00, 0.50:1.00, 0.48:1.00, 0.46:1.00, or 0.44:1.00.

When both uncomplexed and complexed fluorides are present in a working phosphating composition according to the invention and the concentration of NCM in the phosphating composition is less than or equal to the concentration of zinc measured in the same mass-based units: the concentration of complexed fluoride in the phosphating composition preferably is at least, with increasing preference in the order given, 0.25, 0.50, 1.0, 1.5, 1.8, 2.0, 2.2, or 2.4 ppt and independently preferably is not more than, with increasing preference in the order given, 20, 15, 10.0, 7.0, 5.0, 4.0, 3.5, 3.2, 2.9, 2.7, or 2.5 ppt; independently, the concentration of uncomplexed fluoride in the phosphating composition preferably is at least, with increasing preference in the order given, 0.05, 0.10, 0.15, 0.20, 0.25, 0.30, 0.35, 0.40, 0.45, 0.50, 0.54, 0.57, or 0.59 ppt and independently preferably is not more than, with increasing preference in the order given, 7.0, 6.0, 5.0, 4.5, 3.5, 2.5, 2.0, 1.5, 1.00, 0.90, 0.80, 0.70, 0.65, or 0.60 ppt; and, independently, the ratio of uncomplexed fluoride to complexed fluoride preferably is at least, with increasing preference in the order given, 0.02:1.00, 0.04:1.00, 0.06:1.00, 0.08:1.00, 0.10:1.00, 0.12:1.00, 0.14:1.00, 0.16:1.00, 0.18:1.00, 0.20:1.00, 0.22:1.00, or 0.24:1.00 and independently preferably is not more than, with increasing preference in the order given, 2.0:1.00, 1.5:1.00, 1.00:1.00, 0.80:1.00, 0.50:1.00, 0.45:1.00, 0.40:1.00, 0.35:1.00, 0.32:1.00, 0.29:1.00, 0.27:1.00, or 0.25:1.00.

If a phosphating composition according to the invention contains either fluoride only in uncomplexed form or fluoride only in complexed form, then: if the NCM concentration is greater than the zinc concentration in the phosphating composition, the total fluoride content of the composition preferably is at least, with increasing preference in the order given, 0.10, 0.20, 0.30, 0.40, or 0.50 ppt and independently preferably is not more than, 5, 3, 2.0, 1.0, 0.8, or 0.6 ppt; but if the NCM concentration is less than or equal to the zinc concentration in the composition, the total fluoride content of the composition preferably is at least, with increasing preference in the order given, 0.5, 1.0, 1.5, 2.0, 2.5, or 2.9 ppt and independently preferably is, with increasing preference in the order given, not more than 20, 15, 10, 7, 5, or 3.1 ppt.

Independently of other preferences, if a phosphating composition according to the invention contains dissolved fluoride of any type, the ratio of the total dissolved fluoride concentration to the dissolved zinc cations concentration, both measured in the same mass-based units, preferably is at least, with increasing preference in the order given, 0.2:1.00, 0.4:1.00, 0.6:1.00, 0.80:1.00, 0.87:1.00, or 0.92:1.00 and independently preferably is not more than, with increasing preference in the order given, 5:1.00, 3:1.00, 2.0:1.00, 1.8:1.00, 1.6:1.00, 1.4:1.00, 1.20:1.00, or 1.10:1.00.

A phosphating composition according to this invention is necessarily acidic. Its acidity is preferably measured for control and optimization by two characteristics familiar in the art as "points" of Free Acid (hereinafter usually abbreviated as "FA") and of Total Acid (hereinafter usually abbreviated as "TA"). Either of these values is measured by titrating a 10.0 milliliter sample of the composition with 0.100 N strong alkali. If FA is to be determined, the titration is to an end point of pH 3.8 as measured by a pH meter or an indicator such as bromcresol green or bromthymol blue, while if TA is to be determined, the titration is to an end point of pH 8.0 as measured by a pH meter or an indicator such as phenolphthalein. In either instance, the value in points is defined as equal to the number of milliliters of the titrant required to reach the end point.

A working phosphating composition according to this invention preferably has an FA value that is at least, with increasing preference in the order given, 0.1, 0.3, 0.5, 0.7, 0.9, 1.1, 1.3, 1.5, 1.7 or 1.9 points and independently preferably is not more than, with increasing preference in the order given, 10, 8, 6.0, 5.0, 4.5, 4.0, 3.7, 3.5, 3.3, or 3.1 points. Also and independently, a working phosphating composition according to the invention preferably has a TA value that is at least, with increasing preference in the order given, 10, 13, 16, 19, 22, 25, or 27 points and independently preferably is not more than, with increasing preference in the order given, not more than, with increasing preference in the order given, 50, 45, 40, 38, 36, or 34 points. If either the FA or the TA value is too low, the phosphating coating formation will be lower than is usually desired, while if either value is too high there may be excessive dissolution of the substrate and/or suboptimal crystal morphology in the coating formed. Ordinarily, the FA and TA values can be brought within a preferred range by use of appropriate amounts of acidic sources of phosphate, nitrate, and/or complexed fluoride and basic sources of zinc and/or NCM, but if needed, optional component (G) preferably is used to bring the composition within a preferred range of both TA and FA. Alkali metal hydroxides, carbonates, and/or oxides are preferably used for this purpose if alkalinity is needed, and phosphoric acid and/or nitric acid is preferably used if acidity is needed.

Optional component (H) of sludge conditioner is not always needed in a composition according to the invention and therefore is preferably omitted in such instances. However, in many instances, at least one such conditioner may be advantageously used, in order to make separation and collection of any sludge that forms easier. In any such instances, suitable material for these purposes can be readily selected by those skilled in the art. Preferred sludge conditioners are shown in the examples below.

For various reasons, almost always including at least a cost saving from elimination of an unnecessary ingredient, it is preferred that a composition according to this invention should be largely free from various materials often used in prior art compositions. In particular, compositions according to this invention in most instances preferably do not contain, with increasing preference in the order given, and with independent preference for each component named, more than 5, 4, 3, 2, 1, 0.5, 0.25, 0.12, 0.06, 0.03, 0.015, 0.007, 0.003, 0.001, 0.0005, 0.0002, or 0.0001% of each of (i) dissolved calcium cations, (ii) dissolved copper cations, (iii) dissolved aluminum, and (iv) dissolved chromium in any chemical form.

Preferred concentrations have been specified above for working compositions according to the invention, but another embodiment of the invention is make-up concentrate compositions that can be diluted with water only to produce a working composition, and the concentration of ingredients other than water in such a concentrate composition preferably is as high as possible without resulting in instability of the concentrate during storage, in order to minimize the cost of shipping water from a concentrate manufacturer to an end user, who can almost always provide water more cheaply at the point of use.

More particularly, in a concentrate composition according to this invention, the concentration of each ingredient other than water preferably is at least, with increasing preference in the order given, 1.5, 2.0, 2.5, 3.0, 3.5, 4.0 or times as great as the preferred minimum amounts specified above for working compositions according to the invention. In addition to the concentrations recited above, a make-up concentrate preferably has the same ratios between various ingredients as are specified for working compositions above.

A phosphating composition according to the invention is preferably maintained while coating a metal substrate in a process according to the invention at a temperature that is at least, with increasing preference in the order given, 30, 40, 50, 55, 60, 62, 64, 66, or 68° C. and independently preferably is not more than, with increasing preference in the order given, 95, 90, 85, 81, 79, or 77° C.

The specific areal density (also often called "add-on weight [or mass]") of a phosphate coating formed according to this invention preferably is at least, with increasing preference in the order given, 0.3, 0.6, 0.8, 1.0, 1.2, 1.4, or 1.6 grams of dried coating per square meter of substrate coated, this unit of coating weight being hereinafter usually abbreviated as "$g/m^2$", and independently preferably is not more than, with increasing preference in the order given, 10, 8, 6, 5.0, 4.5, 4.0, or 3.5 $g/m^2$. The phosphate conversion coating weight may be measured by stripping the conversion coating in a solution of chromic acid in water as generally known in the art.

Before treatment according to the invention, metal substrate surfaces preferably are conventionally cleaned, rinsed, and "conditioned" with a Jernstedt salt or an at least similarly effective treatment, all in a manner well known in the art for any particular type of substrate; and after a treatment according to the invention the composition according to the invention generally should be rinsed off the surface coated before drying.

This invention is particularly advantageously, and therefore preferably, used on zinciferous metal substrates, such as galvanized steel of all kinds and zinc-magnesium and zinc-aluminum alloys, or more generally any metal alloy surface that is at least 55% zinc, and on such substrates there are two particularly preferred established areas of commercial operation in which this invention is especially advantageous and to which it is therefore highly preferably applied.

In the first of these areas:

the phosphating composition used:

contains at least, with increasing preference in the order given, 2.5, 3.0, 3.3, 3.6, 3.9, 4.1, 4.3, or 4.5 ppt of NCM cations; and contains NMC and zinc cations in a ratio of zinc to NMC that preferably is at least, with increasing preference in the order given, 0.03:1.00, 0.05:1.00, 0.07:1.00, 0.09:1.00, or 0.11:1.00 and independently preferably is not more than, with increasing preference in the order given, 0.9:1.00, 0.7:1.00, 0.5:1.00, 0.40:1.00, 0.35:1.00, 0.30:1.00, 0.25:1.00, 0.20:1.00, or 0.15:1.00; and the phosphating composition is:

in contact during its use in phosphating with at least one surface on which no phosphate coating or other solid coating formation is desired; and maintained during its use at a temperature that preferably is at least, with increasing preference in the order given, 50, 55, 60, 62, 64, 66, or 68° C.

Under such conditions, the formation of scale on the metal surfaces on which no coating is desired is usually a serious problem in the absence of iron in the phosphating composition.

In the second established area of commercial operation in which this invention is most particularly preferred (an area which is not at all necessarily exclusive of the first), the characteristic feature is a very rapid movement of the substrate through the phosphating composition during the phosphating process, a common condition in high speed treatment of coils. When the relative speed of the substrate through the phosphating composition exceeds, with increasing preference in the order given, 100, 125, 150, 160, 165, 170, 175, 180, or 185 meters per minute (this unit of speed being hereinafter usually abbreviated as "m/min"), it has surprisingly been found that dissolution of zinc from the surface of the substrate, which can normally be relied on to provide a sufficient amount of zinc to compensate for the amount consumed as zinc phosphate and make it unnecessary to add zinc in any replenisher for the phosphating composition, is often not effective for this purpose. This is severely limiting, because in prior art practice with phosphating compositions that did not contain dissolved iron cations but were otherwise similar to those according to this invention, it has surprisingly been found that adding a conventional zinc containing replenisher is ineffective, inasmuch as most or all of the zinc content of the replenisher added is rapidly precipitated as sludge. The presence of iron in a composition according to the invention very greatly reduces the amount of sludge formed by adding a replenisher that contains a substantial concentration of zinc, particularly if the replenisher itself also contains dissolved iron cations.

Furthermore, in prior art practice with phosphating compositions similar to those of this invention except for the absence of iron in the prior art compositions, it has surprisingly been found that a high speed of the substrate through the phosphating composition resulted in a crystal morphology in the coating formed that had inferior protective value, compared with a coating formed on the same substrate with the same phosphating when the motion of the substrate through the phosphating composition was lower. This adverse effect also can be eliminated in a process according to this invention.

In any phosphating process according to this invention, as with all or almost all other known phosphating processes, if the initially prepared phosphating composition is to be used for a long period, it is preferred to maintain the effectiveness of the process by adding a suitable replenisher to compensate for any changes in the concentrations of ingredients in the initially prepared phosphating composition that occur as a result of using the phosphating composition. The optimum characteristics of a replenisher composition often depend on the nature of the substrate being coated and the relative speed of motion between the phosphating composition and the substrate being phosphated. For the second of the two established areas of commercial operation in which this invention is most particularly preferred as noted above, a preferred replenisher composition preferably comprises water and the following concentrations of the following other components:

(R2A) a concentration of dissolved phosphate anions that is at least, with increasing preference in the order given, 15, 17, 19, 21, 23, 25, or 27% and independently preferably is not more than, with increasing preference in the order given, 50, 45, 40, 37, 34, 32, 30, or 28%;

(R2B) a concentration of dissolved NCM cations that is at least, with increasing preference in the order given, 1.2, 1.4, 1.6, or 1.8% and independently preferably is not more than, with increasing preference in the order given, 5.0, 4.0, 3.0, 2.5, 2.3, 2.1, or 1.9%;

(R2C) a concentration of dissolved zinc cations that is at least, with increasing preference in the order given, 4.0, 4.2, 4.4, 4.6, 4.8, 5.0, or 5.2% and independently preferably is not more than, with increasing preference in the order given, 15, 12, 10, 8.0, 7.0, 6.0, or 5.5%; and (R2D) a concentration of dissolved iron cations that is at least, with increasing preference in the order given, 0.02, 0.04, 0.06, 0.08, or 0.10%.

Optionally, one or more of undissolved iron cations and the following concentrations of the following components may also be present:

(R2E) a concentration of nitrate ions that is at least, with increasing preference in the order given, 5.0, 5.2, 5.4, 5.6, 5.8, 6.0, or 6.2% and independently preferably is not more than, with increasing preference in the order given, 12, 10, 9.0, 8.0, 7.5, 7.0, 6.8, 6.6, or 6.4 percent;

(R2F) a concentration of dissolved uncomplexed fluoride ions that is at least, with increasing preference in the order given, 0.05, 0.10, 0.15, 0.20, 0.25, 0.30, 0.35, 0.40, 0.45, 0.50, 0.55, or 0.58 percent and independently preferably is not more than, with increasing preference in the order given, 1.5, 1.2, 1.0, 0.90, 0.80, 0.70, 0.65, or 0.62 percent;

(R2G) surfactant that is not part of any of components (R2A) through (R2F) as recited immediately above; and (R2H) sludge conditioner that is not part of any of components (R2A) through (R2G) as recited immediately above.

Preferred surfactant(s) and sludge conditioners are described in the working examples.

For the first of the two established areas of commercial operation in which this invention is most particularly preferred as noted above, if the relative motion between the substrate being phosphated and the phosphating composition during phosphating is not as much as 100 meters per minute, a particularly preferred replenisher composition preferably comprises water and the following concentrations of the following other components:

(R1A) a concentration of dissolved phosphate anions that is at least, with increasing preference in the order given, 13, 15, 17, 19, 21, 23, or 25 percent and independently preferably is not more than, with increasing preference in the order given, 50, 45, 40, 37, 34, 32, 30, 28, or 26 percent;

(R2B) a concentration of dissolved NCM cations that is at least, with increasing preference in the order given, 4.2, 4.4, 4.6, or 4.8% and independently preferably is not more than, with increasing preference in the order given, 8.0, 7.0, 6.0, 5.5, 5.3, 5.1, or 4.9%;

(R2C) a concentration of dissolved zinc cations that is at least, with increasing preference in the order given, 0.50, 0.60, 0.70, 0.80, 0.90, 1.00, or 1.06 percent and independently preferably is not more than, with increasing preference in the order given, 4.0, 3.0, 2.5, 2.0, 1.7, 1.5, 1.3, or 1.1 percent; and (R2D) a concentration of dissolved iron cations that is at least, with increasing preference in the order given, 0.02, 0.04, 0.06, 0.08, or 0.10%.

Optionally, one or more of undissolved iron cations and the following concentrations of the following components may also be present:

(R2E) a concentration of nitrate ions that is at least, with increasing preference in the order given, 3.0, 3.5, 3.7, 3.9, 4.1, 4.3, 4.5, or 4.7% and independently preferably is not more than, with increasing preference in the order given, 10, 8.0, 7.0, 6.5, 6.0, 5.7, 5.4, 5.2, 5.0, or 4.8 percent;

(R2F) a concentration of dissolved uncomplexed fluoride ions that is at least, with increasing preference in the order given, 0.05, 0.10, 0.15, 0.20, 0.25, 0.30, 0.35, 0.40, 0.42, 0.44, 0.46, or 0.48 percent and independently preferably is not more than, with increasing preference in the order given, 1.2, 1.0, 0.90, 0.80, 0.70, 0.60, 0.55, or 0.50 percent;

(R2G) surfactant that is not part of any of components (R2A) through (R2F) as recited immediately above; and (R2H) sludge conditioner that is not part of any of components (R2A) through (R2G) as recited immediately above.

Preferred surfactant(s) and sludge conditioners are described in the working examples.

The practice of this invention may be further appreciated by consideration of the following, non-limiting, working examples, and the benefits of the invention may be further appreciated by reference to the comparison examples.

EXAMPLE AND COMPARISON EXAMPLE 1

In these tests, both working phosphating compositions were made from a concentrate with the ingredients shown in Table 1 below. The working compositions each contained 425 milliliters of this concentrate and 42 grams of sodium carbonate in a total volume of 6.0 liters. Example 1 also contained 4 grams of ferric nitrate nonahydrate crystals, but this ingredient was omitted from Comparison Example 1, which was otherwise identical to Example 1 in concentrations of ingredients other than water. Both working phosphating compositions had FA values of 2.5. The TA value was 31.1 for Example 1 and 30.9 for Comparison Example 1. Each working composition was heated with one of two substantially identical heating elements with a surface of Type 316 stainless steel exposed to the working composition, which was maintained at 71" 5 EC while conventionally cleaned and conditioned galvanized steel test panels were phosphated by immersion for 5 seconds each. The appearance of the phosphated galvanized steel surfaces from Example 1 and Comparison Example 1 was substantially identical in scanning electron micrographs at 1000 diameters magnification. However, after five hours of use, the surfaces of the two immersion heaters were very different. The heater in Example 1 according to the

TABLE 1

| Ingredient | Concentration, as % of the Total Composition, for the Ingredient Shown at Left: |
|---|---|
| 75% Solution of $H_3PO_4$ in water | 21.4 |
| Zinc Oxide | 0.90 |
| Solution in water of nickel nitrate that contains 13.7% nickel and 30% nitrate | 40.7 |
| Solution in water of nickel phosphate that contains 8.1% nickel and 37% phosphate | 8.9 |
| 25% Solution of $H_2SiF_6$ in water | 2.52 |
| 70% Solution of HF in water | 0.40 |
| Additional water | Balance |

invention had a powdery scale that was readily removed by brushing, while the heater in Comparison Example 1 was covered with a tightly adherent solid scale. About 3.5 grams of this solid scale was removed with considerable difficulty from the heater in Comparison Example 1, while only about 0.7 grams of scale could be removed from the heater in Example 1.

A preferred replenisher for use with a high nickel-low zinc phosphating composition as used in Example 1 contains the ingredients shown in Table 2 below.

EXAMPLE 2 AND COMPARISON EXAMPLES 2.1 AND 2.2

In all of these examples, the substrate was also conventionally cleaned and conditioned galvanized steel, but in these examples the steel was passed rapidly through the phosphating composition rather than being immersed in it. In both the Comparison Examples, the phosphating composition contained the ingredients shown in Table 3 below. In Comparison Example 2.1, the phosphating composition was replenished with a conventional replenisher that did not contain zinc or iron, and the speed of the substrate through the phosphating composition was varied. A minimum coating weight of 1.5 $g/m^2$ is required for this operation and was readily achieved at substrate speeds up to 182 m/min. However, when the speed was raised to 199 m/min, satisfactory coating weights could not be maintained.

In Comparison Example 2.2, it was attempted to restore satisfactory coating characteristics by adding a substantial concentration of zinc to the replenisher previously used. This attempt was unsuccessful. As soon as the replenisher began to be added, the phosphating composition became turbid and eventually obvious sludging began.

TABLE 2

| Ingredient | Concentration, as % of the Total Composition, for the Ingredient Shown at Left: |
|---|---|
| 75% Solution of $H_3PO_4$ in water | 29.3 |
| Zinc Oxide | 1.30 |
| Solution in water of nickel nitrate that contains 13.7% nickel and 30% nitrate | 15.9 |
| Solution in water of nickel phosphate that contains 8.1% nickel and 37% phosphate | 8.9 |
| Solid anhydrous $NaH_2PO_4$ | 3.0 |
| 35% Solution of HF in water | 1.46 |
| Solid $Fe(NO_3)_3 \cdot 9H_2O$ | 0.76 |
| Additional water | Balance |

TABLE 3

| Ingredient | Concentration, as % of the Total Composition, for the Ingredient Shown at Left: |
|---|---|
| Phosphate anions | 9.2 |
| Zinc cations | 3.2 |
| Nickel cations | 2.0 |
| Nitrate anions | 4.4 |
| Complex fluoride from $H_2SiF_6$ | 2.4 |
| Uncomplexed fluoride from HF | 0.59 |
| Additional water | Balance |

The coating characteristics did not improve, presumably because substantially all of the zinc cations added in the replenisher were precipitated as zinc phosphate.

In Example 2 according to the invention, a phosphating composition was used that contained the same ingredients for Comparison Example 1 except that 0.062 percent of iron cations was added to the composition as ferric nitrate nonahydrate, not all of which dissolved. The replenisher used had a composition including iron and zinc, as shown in full in Table 4 below. With these operating conditions, required coating weights and other coating characteristics were easily achieved for a period of twelve hours at a substrate speed of 199 m/min, and little or no turbidity and/or sludge formation was observed. The xanthan gum, urea, and sulfonate salt present in this composition are all sludge modifiers.

TABLE 4

| Ingredient | Concentration, as % of the Total Composition, for the Ingredient Shown at Left: |
|---|---|
| 75% Solution of $H_3PO_4$ in water | 37.5 |
| Zinc Oxide | 6.5 |
| Solution in water of nickel nitrate that contains 13.7% nickel and 30% nitrate | 13.1 |
| 70% Solution in water of nitric acid | 3.5 |
| 35% Solution of HF in water | 1.8 |
| Solid $Fe(NO_3)_3 \cdot 9H_2O$ | 0.76 |
| Xanthan gum | 0.10 |
| Prilled urea | 0.05 |
| Sodium 2-ethylhexyl sulfonate | 0.08 |
| Additional water | Balance |

EXAMPLES 3, 3.1 AND 3.2

To further demonstrate the influence of the total amount of ferric salt on sludge and scale formation, three phosphating baths were prepared using varying iron levels as described in Table 5. The baths were built up using BONDERITE 1421 make up (available from the Surface Technologies division of Henkel Corporation, Madison Heights, Mich., U.S.A.) and differing amounts of ferric nitrate nonahydrate. Hot dipped G70 galvanized steel test panels (supplied by ACT) were cleaned with PARCO 1200 cleaner (available from the Surface Technologies division of Henkel Corporation) (14 point, 60° C., 10 seconds), then rinsed with hot water (10 seconds), and treated with PARCOLENE AT conditioner (available from the Surface Technologies division of Henkel Corporation) at 28° C. prior to immersion in the phosphating baths (77-80° C., 5 sec.). Coating weights were measured by stripping using ammonium dichromate, in accordance with conventional practice. Scaling and sludging were evaluated by visual inspection of the reaction vessel and the amount of scale deposited on the immersion heating device over the course of the phosphating operation (approximately 6 hours). At 75 ppm and 7.5 ppm Fe (III) (Examples 3 and 3.2, respectively), acceptable levels of scaling and sludging were observed. Severe sludge and scale formation occurred when operating at 750 ppm Fe (III) (Example 3.1). The phosphating baths for Examples 3 and 3.2 had precipitate present, which suggests that the baths were saturated with ferric salt. Although Example 3.2 (7.5 ppm Fe (III)) gave optimum results (no sludging, minimal scaling), in commercial operation it would be preferable to operate at a somewhat higher Fe (III) level due to the problems associated with trying to precisely maintain a very low concentration of Fe (III), as a relatively minor decrease in the Fe (III) level (e.g., where the level approaches 0 ppm) could lead to severe sludging and scaling problems.

TABLE 5

| Example | Fe (III), ppm | Coating Weight, $g/m^2$ | Sludge | Scale |
|---|---|---|---|---|
| 3 | 75 | 1.98 | Minimal | Minimal |
| 3.1 | 750 | 1.95 | Pronounced | Pronounced |
| 3.2 | 7.5 | 2.07 | None | Minimal |

What is claimed is:

1. An improved phosphating operation wherein metal substrates are either

A. contacted in a bath A with a working phosphating composition A comprised of water, dissolved phosphate anions, dissolved NCM cations, and dissolved zinc cations, wherein said bath A additionally contains at least one piece of process equipment having a surface, and wherein a relatively hard, adherent, and difficult to remove scale forms on said surface when said surface is in contact with said working phosphating composition A for an extended period of time; or B. continually passed at a high rate of speed through a bath B containing a working phosphating composition B comprised of water, dissolved phosphate anions, dissolved NCM cations and dissolved zinc cations, wherein a replenisher composition comprised of zinc cations is periodically added to said working phosphating composition and wherein sludge forms in bath B following such addition of the replenisher composition;

the improvement comprising said working phosphating composition A or said working phosphating composition B comprising a concentration of dissolved zinc cations that is not greater than 0.08 wt. %, wherein the ratio of dissolved zinc cations to dissolved NCM cations is not more than 0.5:1.00, and maintaining a level of dissolved ferric cations in said working phosphating composition A or said working phosphating composition B which is effective to either reduce the amount of scale forming on said surface or reduce the amount of sludge forming in bath B in said working phosphating composition A or working phosphating composition B, wherein working phosphating composition A or working phosphating composition B is maintained at a temperature of at least 66° C.

2. The phosphating operation of claim 1 wherein said high rate of speed is in excess of 100 meters per minute.

3. The phosphating operation of claim 1 wherein working phosphating composition A or working phosphating composition B is additionally comprised of at least one phosphating accelerator.

4. The phosphating operation of claim 1 wherein working phosphating composition A or working phosphating composition B is additionally comprised of dissolved fluoride ions.

5. The phosphating operation of claim 1 wherein working phosphating composition A or working phosphating composition B is additionally comprised of at least one acidity adjustment agent.

6. The phosphating operation of claim 1 wherein working phosphating composition A or working phosphating composition B is additionally comprised of at least one sludge conditioner.

7. The phosphating operation of claim 1 wherein working phosphating composition A or working phosphating composition B is comprised of from 0.2 to 20% dissolved phosphate anions.

8. The phosphating operation of claim 1 wherein working phosphating composition A or working phosphating composition B is comprised of 0.4 to 1.4% dissolved NCM cations.

9. The phosphating operation of claim 1 wherein working phosphating composition A or working phosphating composition B is comprised of a concentration of dissolved zinc cations that is not greater than 0.06 wt. %.

10. The phosphating operation of claim 1 wherein the ratio of dissolved zinc cations to dissolved NCM cations in working phosphating composition A or working phosphating composition B is at least 0.03:1.00 and not greater than 0.4:1.00.

11. The phosphating operation of claim 1 wherein the ratio of dissolved zinc cations to dissolved NCM cations in working phosphating composition A or working phosphating composition B is at least 0.05:1.00 and not greater than 0.3:1.00.

12. The phosphating operation of claim 1 wherein the concentration of dissolved ferric cations in the working phosphating composition A or working phosphating composition B is maintained at a level which is at least 40% of the saturation level for iron ions in the working phosphating composition A or working phosphating composition B.

13. The phosphating operation of claim 1 wherein an amount of total ferric salt is present in the working phosphating composition A or working phosphating composition B that contains at least 20 ppm iron cations.

14. The phosphating operation of claim 1 wherein working phosphating composition A or working phosphating composition B has an FA value of from 0.1 to 10 points.

15. The phosphating operation of claim 1 wherein working phosphating composition A or working phosphating composition B has a TA value of from 10 to 50 points.

16. The phosphating operation of claim 1 wherein working phosphating composition A or working phosphating composition B is maintained at a temperature that is not more than 95° C.

17. The phosphating operation of claim 1 wherein said metal substrates are comprised of a material selected from the group consisting of galvanized steel, zinc magnesium alloys and zinc-aluminum alloys.

18. The phosphating operation of claim 1 wherein working phosphating composition A is comprised of at least 2.5 ppt of NCM cations and has a ratio of zinc cations:NCM cations that is at least 0.003:1.00 and not greater than 0.5:1.00 and is maintained at a temperature of at least 66° C.

19. The phosphating operation of claim 1 wherein said level of dissolved ferric ions in working phosphating composition B is maintained by incorporating a ferric salt in said replenisher composition.

20. The phosphating operation of claim 1 wherein an amount of total ferric salt is present in the working phosphating composition A or working phosphating composition B that contains no more than 400 ppm iron cations.

21. The phosphating operation of claim 1 wherein said level of dissolved ferric cations is at least 4 ppm.

22. The phosphating operation of claim 1 wherein said level of dissolved ferric cations is at least 8 ppm.

23. The phosphating operation of claim 1 wherein said level of dissolved ferric cations is at least 10 ppm.

24. The phosphating operation of claim 1 wherein said high rate of speed is in excess of 180 meters per minute.

25. The phosphating operation of claim 1 wherein the metal substrates are contacted in the bath A with the working phosphating composition A and wherein said level of dissolved ferric cations in said working phosphating composition A is effective to reduce the amount of solid scale forming on said surface.

26. The phosphating operation of claim 25 wherein said level of dissolved ferric cations in said working phosphating composition A is effective to reduce the amount of solid scale forming on a surface of a heater that is in contact with said working phosphating composition A during said phosphating operation.

* * * * *